US009854633B1

(12) United States Patent
Lee et al.

(10) Patent No.: US 9,854,633 B1
(45) Date of Patent: Dec. 26, 2017

(54) LIGHT EMITTING DEVICE ARRAY AND LIGHT SOURCE DEVICE USING THE SAME

(71) Applicant: Samsung Electronics Co., Ltd., Suwon-si (KR)

(72) Inventors: Bong Jin Lee, Hwasung (KR); Kil Yoan Chung, Hwasung (KR)

(73) Assignee: SAMSUNG ELECTRONICS CO., LTD., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/437,020

(22) Filed: Feb. 20, 2017

(30) Foreign Application Priority Data

Aug. 19, 2016 (KR) ..... 10-2016-0105737

(51) Int. Cl.
*H05B 33/08* (2006.01)

(52) U.S. Cl.
CPC ..... *H05B 33/083* (2013.01)

(58) Field of Classification Search
CPC .... H05B 37/02; H05B 33/08; H05B 33/0812; H05B 33/0842; H05B 33/0845; H05B 33/0881; H05B 33/083
USPC .... 315/151–158, 185 R, 224–226, 291, 307, 315/308, 312
See application file for complete search history.

(56) References Cited

U.S. PATENT DOCUMENTS 6,372,608 B1 4/2002 Shimoda et al.
6,645,830 B2 11/2003 Shimoda et al.
RE38,466 E 3/2004 Inoue et al.
6,818,465 B2 11/2004 Biwa et al.
6,818,530 B2 11/2004 Shimoda et al.
6,858,081 B2 2/2005 Biwa et al.
6,967,353 B2 11/2005 Suzuki et al.
7,002,182 B2 2/2006 Okuyama et al.
7,084,420 B2 8/2006 Kim et al.
7,087,932 B2 8/2006 Okuyama et al.
7,154,124 B2 12/2006 Han et al.
7,208,725 B2 4/2007 Sherrer et al.
7,288,758 B2 10/2007 Sherrer et al.
7,319,044 B2 1/2008 Han et al.
7,501,656 B2 3/2009 Han et al.
7,709,857 B2 5/2010 Kim et al.
7,759,140 B2 7/2010 Lee et al.
7,781,727 B2 8/2010 Sherrer et al.
7,790,482 B2 9/2010 Han et al.
(Continued)

FOREIGN PATENT DOCUMENTS

KR 10-0952499 B1 4/2010
KR 10-2011-0051500 A 5/2011
(Continued)

*Primary Examiner* — Jimmy Vu
(74) *Attorney, Agent, or Firm* — Muir Patent Law, PLLC

(57) ABSTRACT

A light emitting device array comprises a plurality of light emitting diode (LED) strings connected in parallel to each other, each of which includes a plurality of light emitting devices connected in series. A sum of forward voltages (Vf) of a plurality of light emitting devices included in at least one LED string among the plurality of LED strings is less than that of forward voltages of a plurality of light emitting devices included in a different LED string. The at least one LED string includes a voltage compensation unit, to compensate for a difference in forward voltage levels between the at least one LED string and the different LED string.

20 Claims, 9 Drawing Sheets

(56) References Cited

U.S. PATENT DOCUMENTS

| | | | | |
|---|---|---|---|---|
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,459,832 | B2 | 6/2013 | Kim | |
| 8,502,242 | B2 | 8/2013 | Kim | |
| 8,536,604 | B2 | 9/2013 | Kwak et al. | |
| 8,735,931 | B2 | 5/2014 | Han et al. | |
| 8,766,295 | B2 | 7/2014 | Kim | |
| 9,030,459 | B2 | 5/2015 | Fang et al. | |
| 2006/0220586 | A1 | 10/2006 | Latham | |
| 2013/0193851 | A1 | 8/2013 | Alon et al. | |
| 2016/0050725 | A1 | 2/2016 | Johnston et al. | |
| 2016/0081145 | A1* | 3/2016 | Peeters ..... | H05B 33/0827 315/185 R |
| 2016/0366731 | A1* | 12/2016 | Palfreyman ..... | F21V 23/06 |

FOREIGN PATENT DOCUMENTS

| | | | |
|---|---|---|---|
| KR | 10-1616715 | B1 | 4/2016 |
| KR | 10-2016-0056651 | A | 5/2016 |

* cited by examiner

LIGHT EMITTING DEVICE ARRAY AND LIGHT SOURCE DEVICE USING THE SAME

CROSS-REFERENCE TO RELATED APPLICATION

This application claims benefit of priority under 35 U.S.C. §119 to Korean Patent Application No. 10-2016-0105737 filed on Aug. 19, 2016, with the Korean Intellectual Property Office, the disclosure of which is incorporated herein by reference in its entirety.

BACKGROUND

1. Field

The present disclosure relates to a light emitting device array and a light source device.

2. Description of Related Art

Semiconductor light emitting devices (e.g., including light emitting diodes (LEDs)) may emit light using the principle of recombination of electrons and holes when an electric current is applied thereto. Due to various advantages thereof, such as low power consumption, high luminance, miniaturization, and the like, semiconductor light emitting devices (e.g., including semiconductor LEDs) are widely used as light sources of various electronic products, as well as light sources for lighting devices. For example, since the development of nitride-based light emitting devices, the range of use thereof has been further extended, and thus, nitride-based light emitting devices have been employed in light source modules, domestic lighting devices, automotive lighting devices, and the like. In particular, semiconductor light emitting devices are commonly used as light sources for various display devices such as TVs, mobile phones, PCs, notebook computers, personal digital assistants (PDAs), and the like.

In addition, as the range of use of semiconductor light emitting devices has been extended, semiconductor light emitting devices have gradually been applied to light source devices having a high level of electric current and power. As semiconductor light emitting devices have been applied to light source devices having a high level of electric current and power, research into methods of improving reliability of semiconductor light emitting device packages has been undertaken.

SUMMARY

An aspect of the present disclosure may provide a light emitting device array and a light source device, having improved reliability due to a reduction in a forward voltage deviation (ΔVf).

According to an aspect of the present disclosure, a light emitting device array may comprise a plurality of light emitting diode (LED) strings connected in parallel with each other, each LED string including a plurality of light emitting devices connected in series, wherein a sum of forward voltages (Vf) of corresponding plurality of light emitting devices included in at least one LED string among the plurality of LED strings is less than a sum of forward voltages of corresponding plurality of light emitting devices included in a different LED string, and the at least one LED string includes a voltage compensation unit configured to compensate for a difference in forward voltage levels between the at least one LED string and the different LED string.

According to an aspect of the present disclosure, a light source device may comprise a plurality of LED strings connected in parallel, each LED string including a plurality of light emitting devices connected in series, wherein each of the plurality of LED strings includes an impedance controlling pattern electrically connected to a corresponding plurality of light emitting devices, and is configured such that a level of a forward voltage applied to the corresponding plurality of light emitting devices included in at least one LED string among the plurality of LED strings is lower than a level of a forward voltage applied to the corresponding plurality of light emitting devices included in a different LED string, and the at least one LED string includes an impedance controlling pattern, different from an impedance controlling pattern of the different LED string and connected to the corresponding plurality of light emitting devices in series, and the impedance controlling pattern included in the at least one LED string is configured to compensate for a difference in forward voltage levels applied to the at least one LED string and to the different LED string.

According to an aspect of the present disclosure, a light emitting device array may comprise a first light emitting diode (LED) string connected in parallel with a second LED string, each of the first and second LED strings including a plurality of light emitting devices connected in series, a voltage compensation unit connected in series to one of opposing ends of the plurality of light emitting devices included in the first LED string, wherein a sum of forward voltages (Vf) of the plurality of light emitting devices included in first LED string is less than a sum of forward voltages of the plurality of light emitting devices included in the second LED string, and the voltage compensation unit is configured to compensate for a difference in forward voltage levels between the first LED string and the second LED string.

BRIEF DESCRIPTION OF DRAWINGS

The above and other aspects, features and other advantages of the present disclosure will be more clearly understood from the following detailed description when taken in conjunction with the accompanying drawings, in which.

DETAILED DESCRIPTION

Figure 1:
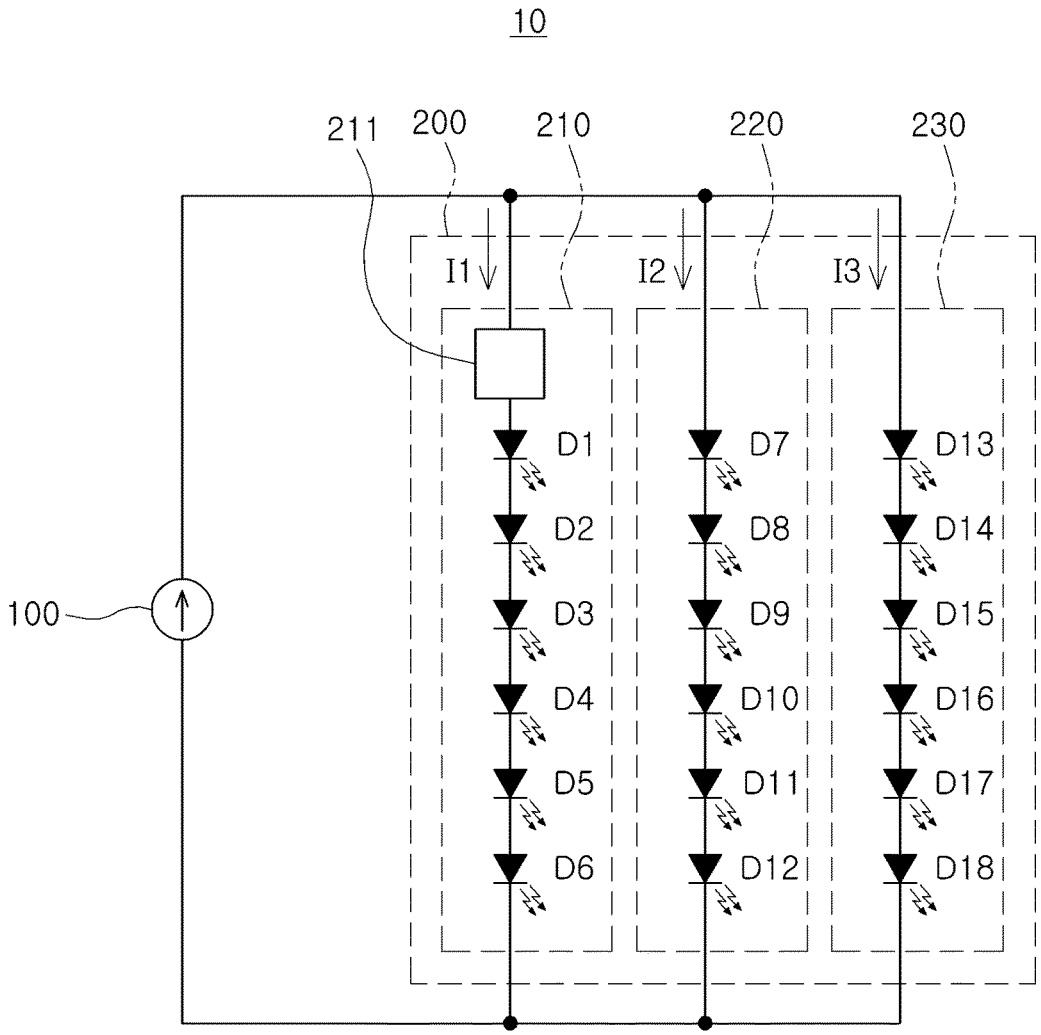
FIG. 1 is a circuit diagram of a light source device according to an example embodiment of the present inventive concept.

Although the figures described herein may be referred to using language such as "one embodiment," or "certain embodiments," these figures, and their corresponding descriptions are not intended to be mutually exclusive from other figures or descriptions, unless the context so indicates. Therefore, certain aspects from certain figures may be the same as certain features in other figures, and/or certain figures may be different representations or different portions of a particular exemplary embodiment.

It will be understood that, although the terms first, second, third etc. may be used herein to describe various elements, components, regions, layers and/or sections, these elements, components, regions, layers and/or sections should not be limited by these terms. Unless the context indicates otherwise, these terms are only used to distinguish one element, component, region, layer or section from another element, component, region, layer or section, for example as a naming convention. Thus, a first element, component, region, layer or section discussed below in one section of the specification could be termed a second element, component, region, layer or section in another section of the specification or in the claims without departing from the teachings of the present invention. In addition, in certain cases, even if a term is not described using "first," "second," etc., in the specification, it may still be referred to as "first" or "second" in a claim in order to distinguish different claimed elements from each other.

It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, or as "contacting" or "in contact with" another element, there are no intervening elements present. Other words used to describe the relationship between elements should be interpreted in a like fashion (e.g., "between" versus "directly between," "adjacent" versus "directly adjacent," etc.).

The term "substantially" may be used herein to emphasize this meaning, unless the context or other statements indicate otherwise. For example, items described as "substantially the same," "substantially equal," or "substantially planar," may be exactly the same, equal, or planar, or may be the same, equal, or planar within acceptable variations that may occur, for example, due to manufacturing processes.

As is traditional in the field of the inventive concepts, embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope of the inventive concepts. Further, the blocks, units and/or modules of the embodiments may be physically combined into more complex blocks, units and/or modules without departing from the scope of the inventive concepts.

Figure 2:
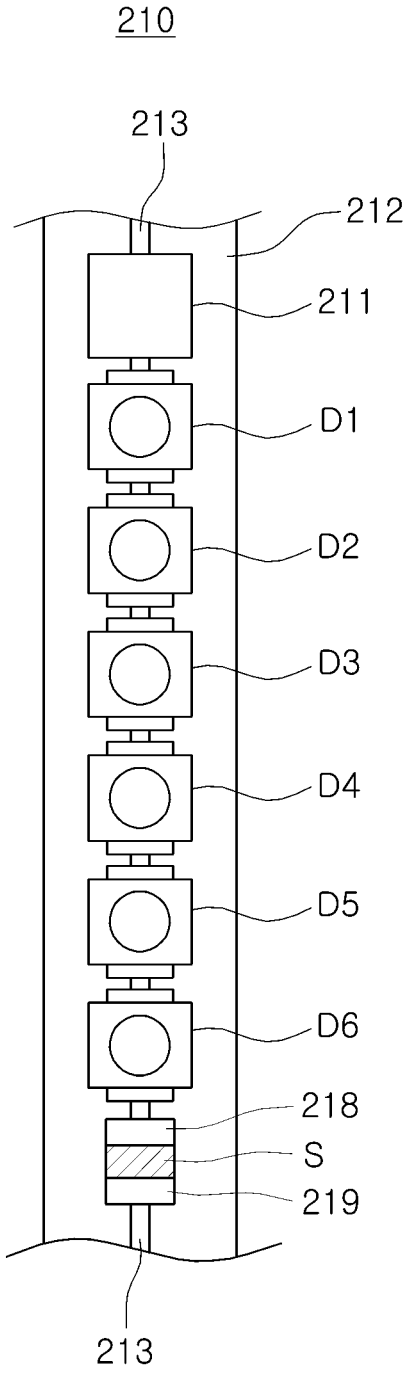
FIG. 2 is a top plan view of a first LED string according to an example embodiment.
Figure 3:
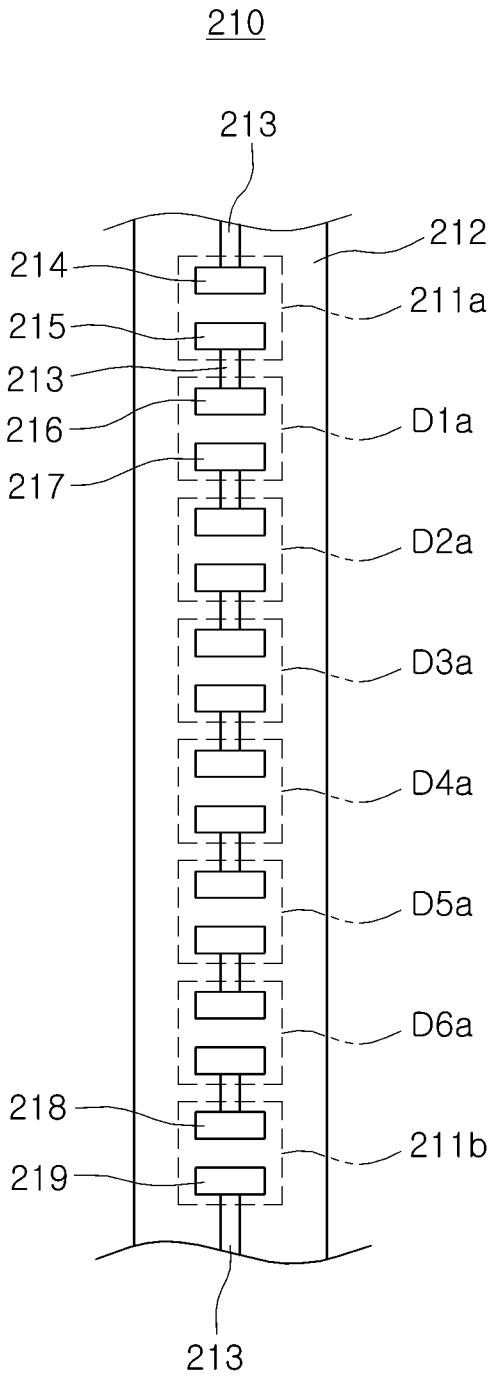
FIG. 3 is a top plan view of a circuit board of the first LED string according to an example embodiment.

FIG. 1 is a circuit diagram of a light source device according to an example embodiment of the present inventive concept; FIG. 2 is a top plan view of a first light emitting diode (LED) string according to an example embodiment; and FIG. 3 is a top plan view of a circuit board of the first LED string according to an example embodiment.

As illustrated in FIG. 1, a light source device 10, according to an example embodiment, may include a light emitting device array 200 in which a plurality of LED strings 210, 220, and 230 are connected in parallel, and may include a power supply unit 100 supplying driving power to the light emitting device array 200. The light emitting device array 200 may also be referred to as an LED module.

The light emitting device array 200 may include the plurality of LED strings 210, 220, and 230, connected in parallel (e.g., between a potential difference), while the plurality of LED strings 210, 220, and 230 may include a plurality of light emitting devices D1 to D6, D7 to D12, and D13 to D18, connected in series, respectively. A number of light emitting devices included in each of the plurality of LED strings 210, 220, and 230 may be equal. The example embodiment illustrates a case in which the light emitting device array 200 may include a first LED string 210, a second LED string 220, and a third LED string 230, while the first LED string 210, the second LED string 220, and the third LED string 230 may include six light emitting devices D1 to D6, D7 to D12, and D13 to D18, respectively. However, the case described above is to facilitate a description thereof. A number of light emitting devices configuring LED strings and a number of LED strings are not limited to a specific number, and may be determined by power that the power supply unit 100 may supply to the light emitting device array 200. For example, the light emitting device array 200 may include more than three or less than three LED strings and each LED string may include more than six or less than six light emitting devices.

A portion among the first LED string 210, the second LED string 220, and the third LED string 230 may include a voltage compensation unit 211. The voltage compensation unit 211 may increase a forward voltage Vf of the first LED string 210, thus reducing a deviation ($\Delta Vf$) of forward voltage levels between the first LED string 210 and the two other strings, the second LED string 220 and the third LED string 230. Therefore, electric currents I1, I2, and I3, applied to the first LED string 210, the second LED string 220, and the third LED string 230, respectively, may be maintained to be substantially uniform, which will be subsequently described.

A first LED string 210, a second LED string 220, and a third LED string 230 will be described in detail, with reference to FIGS. 2 and 3. Since the second LED string 220 and the third LED string 230 are different from the first LED string 210 only in that a voltage compensation unit 211 is omitted, only the first LED string 210 will be described, in order to avoid an overlapping description.

FIG. 2 is an enlarged view of a portion of the first LED string 210, while FIG. 3 is an enlarged view of a portion of a circuit board 212 in which light emitting devices D1 to D6 and the voltage compensation unit 211 are removed from the first LED string 210.

As illustrated in FIG. 2, the first LED string 210 may include the circuit board 212, the voltage compensation unit 211 and a plurality of light emitting devices D1 to D6, mounted on the circuit board 212 and connected in series, a wiring 213 connecting the voltage compensation unit 211 to the plurality of light emitting devices D1 to D6.

The circuit board 212 may provide a region in which the voltage compensation unit 211 and the plurality of light emitting devices D1 to D6 are mounted, and may be provided as a printed circuit board. The wiring 213 may be provided as a printed circuit of the printed circuit board. With reference to FIG. 3, the circuit board 212 may include voltage compensation unit mounting regions 211*a* and 211*b* in which a voltage compensation unit 211 may be mounted, and may include light emitting device mounting regions D1*a* to D6*a* in which a light emitting device may be mounted. In this exemplary embodiment, the voltage compensation unit 211 is connected to the first LED string 210 in series. A pair of electrode pads among electrode pads 214 to 219 may be disposed in each of the regions. The wiring 213 may be connected to each of the electrode pads 214 to 219, thus electrically connecting the voltage compensation unit to a plurality of light emitting devices mounted on the circuit board 212. The electrode pads 214 to 219 may be chip pads. The various pads of a device described herein may be conductive terminals connected to internal wiring of the device, and may transmit signals and/or supply voltages between an internal wiring and/or internal circuit of the device and an external source. For example, chip pads of a semiconductor chip may electrically connect to and transmit supply voltages and/or signals between an integrated circuit of the semiconductor chip and a device to which the semiconductor chip is connected. The various pads may be provided on or near an external surface of the device and may generally have a planar surface area (often larger than a corresponding surface area of the internal wiring to which they are connected) to promote connection to a further terminal, such as a bump or solder ball, and/or an external wiring.

The voltage compensation unit mounting regions 211*a* and 211*b* may be disposed on respective opposing ends of the light emitting device mounting regions D1*a* to D6*a*. In this exemplary embodiment, the light emitting devices D1 to D6 are provided in series in the light emitting device mounting regions D1*a* to D6*a*, respectively, such that the light emitting device D1 is connected to the voltage compensation unit 211 mounted in the voltage compensation unit mounting region 211*a* and the light emitting device D6 is connected to the voltage compensation unit 211 mounted in the voltage compensation unit mounting region 211*b* via the wiring 213.

The voltage compensation unit may be mounted in one of two voltage compensation unit mounting regions 211*a* and 211*b*. In a region in which the voltage compensation unit is not mounted, among the voltage compensation unit mounting regions 211*a* and 211*b*, a pair of electrode pads may be short-circuited. The example embodiment illustrates that electrode pads 218 and 219, in a lower portion of the circuit board 212, are short-circuited. The electrode pads 218 and 219 are illustrated to be short-circuited by a solder S, but the present disclosure is not limited thereto. A pair of electrode pads 218 and 219 may be connected by an electric wire.

Electrode pads 215 and 218, connected by the light emitting device mounting regions D1*a* to D6*a* and the wiring 213, among an electrode pad 214, an electrode pad 215, an electrode pad 218, and an electrode pad 219 of the voltage compensation unit mounting regions 211*a* and 211*b*, may be used as a connection terminal measuring a forward voltage of the plurality of light emitting devices D1 to D6 that are mounted, before the voltage compensation unit 211 is mounted.

Figure 4:
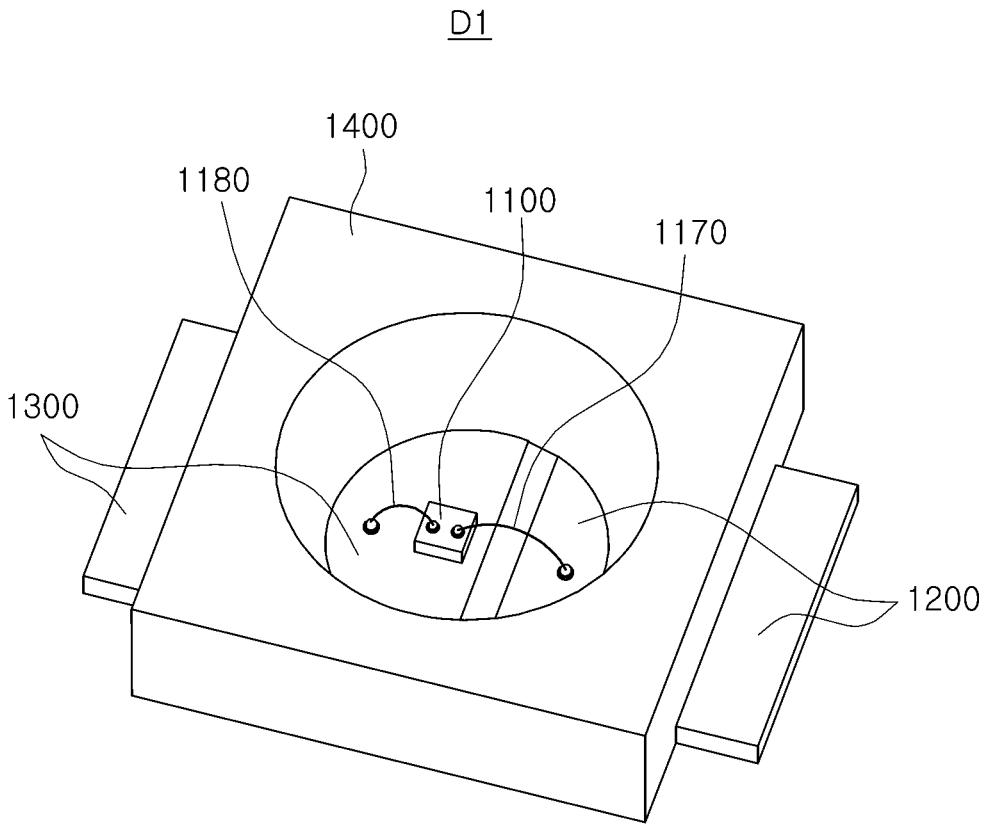
FIG. 4 is a perspective view of an LED package employable in the first LED string in the exemplary embodiment of FIG. 3.

Any device that may emit light when an electrical signal is applied thereto may be used as one of the plurality of light emitting devices D1 to D6. The example embodiment illustrates a case in which an LED package is used as an example. FIG. 4 illustrates an example of an LED package employable as light emitting devices D1 to D6. The LED package may include a package body 1400 having lead frames 1200 and 1300, as well as an LED chip 1100.

The package body 1400 may include a first lead frame 1200 and a second lead frame 1300, while the LED chip 1100 may be mounted in a region of the second lead frame 1300. The LED chip 1100 may be connected the first lead frame 1200 and the second lead frame 1300 by an electric wire 1180. The package body 1400 may be formed in such a manner that an insulating resin is molded in a region of the first lead frame 1200 and the second lead frame 1300. A region in which the LED chip 1100 of the package body 1400 is mounted may have a concave circumferential surface inclined inwardly toward the LED chip 1100.

In some embodiments, the LED chip 1100 may be mounted on a surface of the second lead frame 1300. In addition, any device that may emit light when an electrical signal is applied thereto may be used as the LED chip 1100. For example, a semiconductor LED chip in which a semiconductor layer is epitaxially grown on a semiconductor growth substrate may be used.

A voltage compensation unit 211 may be connected to one of opposing ends of a plurality of light emitting devices D1 to D6, in series, and compensate for a relatively low forward voltage (Vf) of the plurality of light emitting devices D1 to D6, so that forward voltages of LED strings may be adjusted to be uniform. The voltage compensation unit 211 may be provided as at least one of a resistor and a diode, or the like, in order to compensate for a forward voltage deviation (ΔVf) of the LED strings 210, 220, and 230 having a relatively low forward voltage Vf.

Various types of resistors having an additional device may be used according to exemplary embodiments. However, an impedance controlling pattern controlling an entirety of a resistance value in such a manner that a wiring having a specific unit resistance value is provided to have a predetermined length and width, and a length and a width of the wiring are controlled may be used. A detailed description thereof will be subsequently provided.

In addition, various types of diodes, to which a specific level of a forward voltage is applied, such as a rectifier diode, a zener diode, or the like, may be used according to exemplary embodiments.

A level of a forward voltage applied to the voltage compensation unit 211 may be determined in such a manner that respective forward voltages of a first LED string 210, a second LED string 220, and a third LED string 230 are measured, and a forward voltage deviation (ΔVf) among the first LED string 210, the second LED string 220, and the third LED string 230 is calculated. The example embodiment illustrates an example in which a level of a forward voltage of the first LED string 210 is lower than a level of a forward voltage of the first LED string 220 and the third LED string 230. For example, a sum of forward voltages (Vf) of the plurality of light emitting devices D1 to D6 included in the first LED string 210 is less than a sum of forward voltages of a plurality of light emitting devices D7 to D12 included in the second LED string 220 and a sum of forward voltages (Vf) of the plurality of light emitting devices D1 to D6 included in the first LED string 210 is less than a sum of forward voltages of a plurality of light emitting devices D13 to D18 included in the third LED string 230.

In a case in which the level of a forward voltage applied to the voltage compensation unit 211 is determined, a resistor or a diode having the level of a forward voltage may be selected and mounted in one of the voltage compensation unit mounting regions 211*a* and 211*b* of the first LED string 210, thus forming the voltage compensation unit 211.

Figure 5:
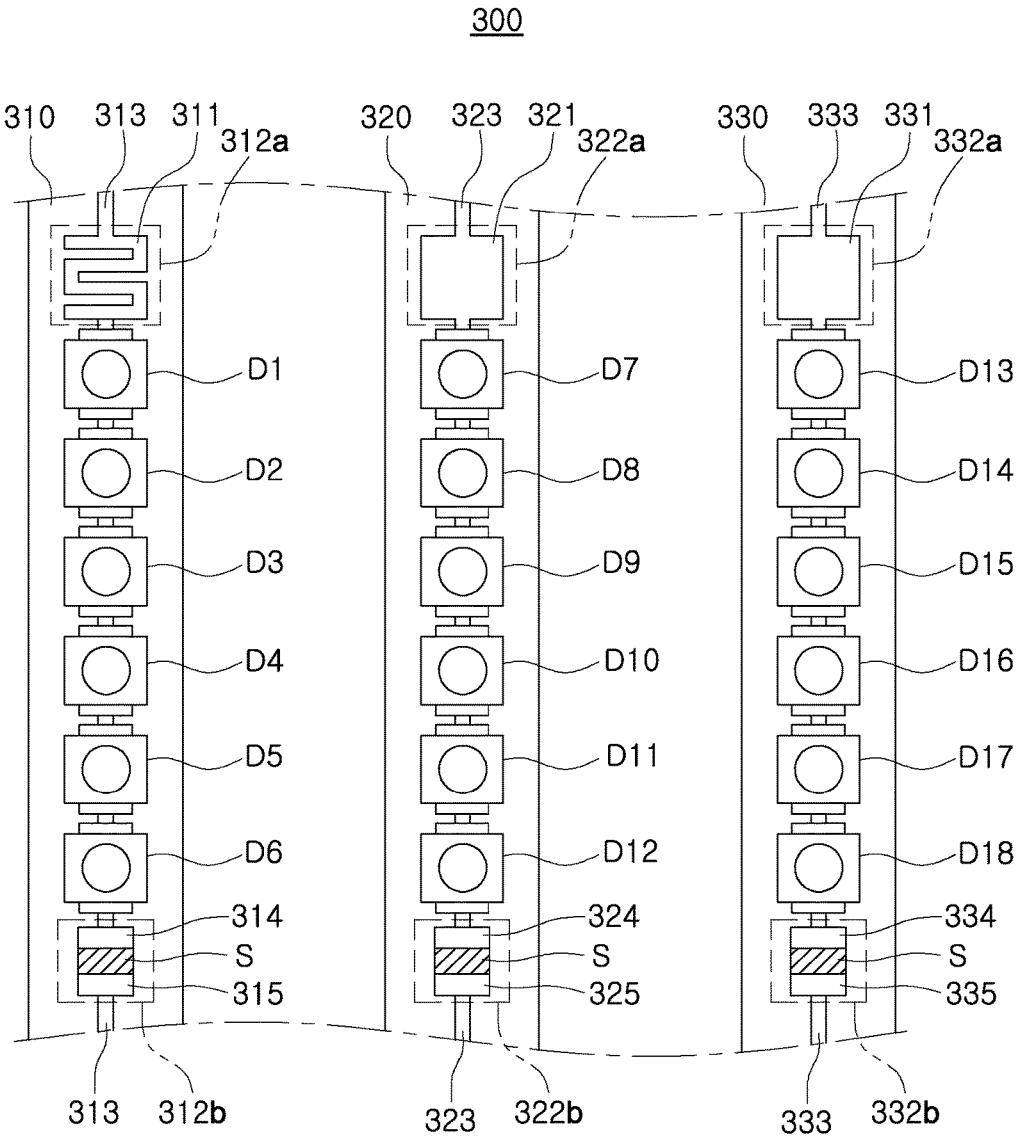
FIG. 5 is a top plan view of a light emitting device array according to an example embodiment.
Figure 6A:
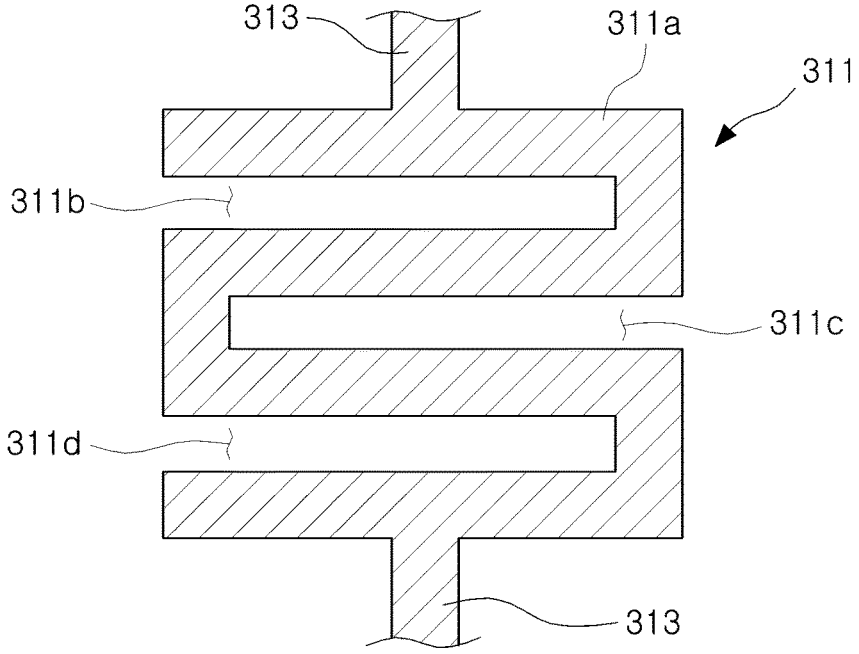
FIG. 6A is a top view of a voltage compensation unit according to the exemplary embodiment of FIG. 5.
Figure 6B:
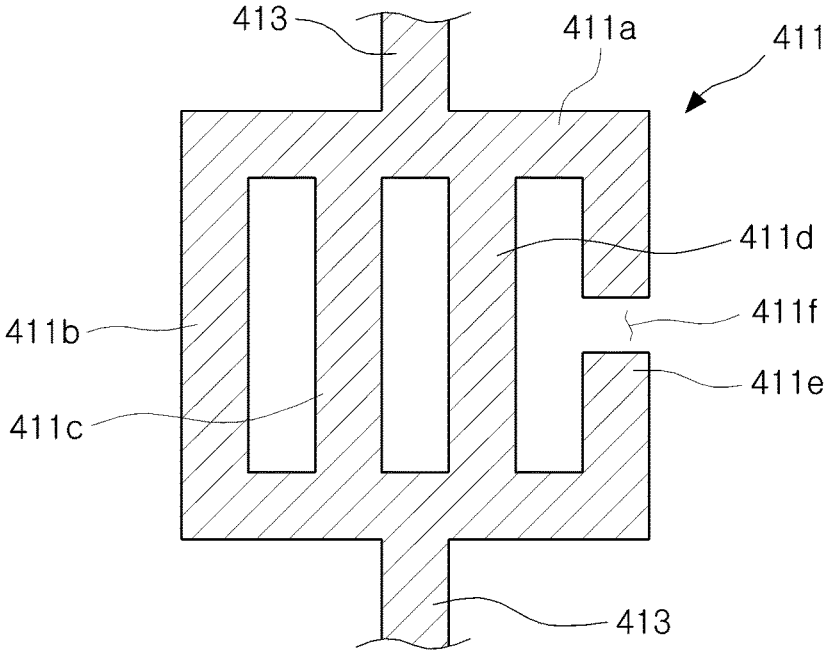
FIG. 6B is a modified example embodiment of the voltage compensation unit in FIG. 6A.

An example in which a voltage compensation unit includes an impedance controlling pattern will be described, with reference to the exemplary embodiments as illustrated in FIGS. 5 and 6. FIG. 5 is a top plan view of a light emitting device array according to an example embodiment; FIG. 6A is a top plan view of a voltage compensation unit in FIG. 5; and FIG. 6B is a modified example of the voltage compensation unit in FIG. 6A.

A light emitting device array 300, in an example embodiment, may have a composition similar to that of an example embodiment described above, but may be different in that the voltage compensation unit is provided as impedance controlling patterns 311, 321, and 331.

The light emitting device array 300, in the example embodiment, may include a first LED string 310, a second LED string 320, and a third LED string 330. In addition, the first LED string 310, the second LED string 320, and the third LED string 330 may include a plurality of light emitting devices D1 to D6, D7 to D12, and D13 to D18, respectively. In an example embodiment described above, a resistor or a diode corresponding to a forward voltage applied to the voltage compensation unit may be selected, and may be mounted in a voltage compensation unit mounting region, thus providing the voltage compensation unit. In the example embodiment, the impedance controlling pattern may be formed in a region of a wiring printed on a circuit board, thus providing the voltage compensation unit. For example, the impedance controlling pattern 311 may be mounted in one of two voltage compensation unit mounting regions 312*a* and 312*b*, the impedance controlling pattern 321 may be mounted in one of two voltage compensation unit mounting regions 322*a* and 322*b*, and the impedance controlling pattern 331 may be mounted in one of two voltage compensation unit mounting regions 332*a* and 332*b*. In a region in which the impedance controlling pattern 311 is not mounted, among the voltage compensation unit mounting regions 312*a* and 312*b*, a pair of electrode pads 314 and 315 may be short-circuited. This example embodiment illustrates that electrode pads 314 and 315, in a lower portion of a circuit board where the first LED string 310 is mounted, are short-circuited. The electrode pads 314 and 315 are illustrated to be short-circuited by a solder S, but the present inventive concept is not limited thereto. A pair of electrode pads 314 and 315 may be connected by an electric wire. In a region in which the impedance controlling pattern 321 is not mounted, among the voltage compensation unit mounting regions 322*a* and 322*b*, a pair of electrode pads 324 and 325 may be short-circuited. The example embodiment illustrates that electrode pads 324 and 325, in a lower portion of a circuit board where the first LED string 320 is mounted, are short-circuited. The electrode pads 324 and 325 are illustrated to be short-circuited by a solder S, but the present inventive concept is not limited thereto. A pair of electrode pads 324 and 325 may be connected by an electric wire. In a region in which the impedance controlling pattern 331 is not mounted, among the voltage compensation unit mounting regions 332*a* and 332*b*, a pair of electrode pads 334 and 335 may be short-circuited. The example embodiment illustrates that electrode pads 334 and 335, in a lower portion of a circuit board where the first LED string 330 is mounted, are short-circuited. The electrode pads 334 and 335 are illustrated to be short-circuited by a solder S, but the present inventive concept is not limited thereto. A pair of electrode pads 334 and 335 may be connected by an electric wire.

The first LED string 310, the second LED string 320, and the third LED string 330 in FIG. 5 may include impedance controlling patterns 311, 321, and 331, respectively. In this exemplary embodiment, the light emitting devices D1 to D6 are provided in series in the first LED string 310 in a manner such that the light emitting device D1 is connected to the impedance controlling pattern 311 and the light emitting device D6 is connected to the electrode pad 314 among the electrode pads 314 and 315 mounted in the voltage compensation unit mounting region 312*b* via the wiring 313. In this exemplary embodiment, the light emitting devices D7 to D12 are provided in series in the second LED string 320 in a manner such that the light emitting device D7 is connected to the impedance controlling pattern 321 and the light emitting device D12 is connected to the electrode pad 324 among the electrode pads 324 and 325 mounted in the voltage compensation unit mounting region 322*b* via the wiring 323. In this exemplary embodiment, the light emitting devices D13 to D18 are provided in series in the third LED string 330 in a manner such that the light emitting device D13 is connected to the impedance controlling pattern 331 and the light emitting device D18 is connected to the electrode pad 334 among the electrode pads 334 and 335 mounted in the voltage compensation unit mounting region 332*b* via the wiring 333.

In addition, the impedance controlling patterns 311, 321, and 331 may determine a shape of a pattern, thus controlling an impedance value. The example embodiment illustrates a case in which a level of a forward voltage of a plurality of light emitting devices D1 to D6 included in the first LED string 310 is lower than that of a forward voltage of a plurality of light emitting devices D7 to D12 and light emitting devices D13 to D18, included in the second LED string 320 and the third LED string 330. In addition, the example embodiment illustrates a case in which only a shape of the impedance controlling pattern 311 of the first LED string 310 is adjusted, as an example. The impedance controlling patterns 311, 321, and 331 may be formed to be integrated with wirings 313, 323, and 333.

With reference to exemplary embodiments as illustrated in FIGS. 5 and 6A, it can be determined that the impedance controlling pattern 311 of the first LED string 310 has a pattern path longer than those of the impedance controlling patterns 321 and 331 of the first LED string 310 and the second LED string 320. The pattern path may be provided in such a manner that a quadrangular wiring, such as wirings in the impedance controlling patterns 321 and 331 of the first LED string 310 and the second LED string 320, is laser trimmed, and grooves 311*b*, 311*c*, and 311*d* are formed. As illustrated in FIG. 6A, in a case in which the impedance controlling pattern 311 is laser trimmed, a length of a path 311*a* may be increased by three times or more, and a width thereof may be reduced to a seventh or less of the width thereof, than before a laser trimming process is performed thereon. Therefore, a resistance value of the impedance controlling pattern 311 may be increased, so that a level of a forward voltage applied to the impedance controlling pattern 311 may be increased. Therefore, the impedance controlling pattern 311 may be laser trimmed, thus controlling a forward voltage applied thereto.

FIG. 6B is a modified example of an impedance controlling pattern, and illustrates a case in which a width of a path 411*a* of an impedance controlling pattern 411 is reduced. The example embodiment illustrates a case in which the path 411*a* of an impedance controlling pattern 411 may be divided into four sub-paths 411*b*, 411*c*, 411*d*, and 411*e*, in advance, and a portion of the sub-paths 411*b*, 411*c*, 411*d*, and 411*e* may be cut using a laser trimming process, thus reducing the width of the path 411*a* and increasing a resistance value of the impedance controlling pattern 411. The example embodiment illustrates a region 411*f* in which a sub-path 411*e* at the rightmost end, among the four sub-paths 411*b*, 411*c*, 411*d*, and 411*e*, is cut and separated. The impedance controlling pattern 411 may be formed to be integrated with a wiring 413.

The impedance controlling pattern may provide the voltage compensation unit by forming a wiring pattern in a region of a printed wiring, using the laser trimming process without a need to mount a separate device. Therefore, the impedance controlling pattern may be used in a case in which the space of a circuit board is narrow.

Referring to FIG. 1, a power supply unit 100 may rectify alternating current (AC) power applied by a separate power supply unit, and may supply the rectified AC power to the light emitting device array 200 as driving power supply. An AC/DC converter, used to convert a converted direct current (DC) voltage into an electric current appropriate for driving the light emitting device array 200, may be used as the power supply unit 100. For example, in a case in which a level of a voltage of an external power supply is higher than a driving voltage of a light emitting device, a buck converter may be used. In a case in which the level of a voltage of the external power supply is lower than the driving voltage of the light emitting device, a boost converter may be used. In the example embodiment, the boost converter may be used.

The power supply unit 100 may supply substantially the same level of electric currents to a first LED string 210, a second LED string 220, and a third LED string 230.

The light emitting device array 200 having a composition described above may improve reliability of the light source device 10 in such a manner that an electric current applied to respective LED strings is uniform. Even in the case of light emitting devices in the same rank, a forward voltage deviation ($\Delta Vf$) among the light emitting devices may occur by a nominal error in a manufacturing process. Therefore, in the case of an LED string connecting a plurality of light emitting devices in series, a forward voltage deviation may occur. In a case in which a plurality of LED strings are connected in parallel, and power is applied thereto, a phenomenon of non-uniform distribution of an electric current, in which a relatively high level of an electric current is applied to an LED string having a relatively low forward voltage value, may occur.

In a case in which the phenomenon of non-uniform distribution of an electric current occurs in a portion of LED strings among light emitting device arrays, an excessive electric current may be applied to an LED string, and power exceeding rated power is consumed. Therefore, a temperature in the LED string may be increased to a high degree. Consequently, physical alteration, such as damage to the light emitting device of the LED string or a gap between the circuit board and the wiring of the circuit board including the light emitting device mounted thereon, may occur. The physical alteration may cause a problem in which a lifespan of the light emitting device array or the light source device may be reduced.

Therefore, in order to prevent the phenomenon of non-uniform distribution of an electric current from occurring, it is desirable to reduce the forward voltage deviation applied to respective LED strings. In the example embodiment, a forward voltage of respective LED strings may be measured, the forward voltage deviation among the LED strings may be calculated, and the voltage compensation unit, compensating for the forward voltage deviation, may be disposed in the LED strings having a relatively low forward voltage, thus reducing the forward voltage deviation among the LED strings.

An effect of a reduction in a forward voltage deviation among a plurality of LED strings, in an example embodiment, will be described, with reference to FIGS. 7 to 9.

Figure 7:
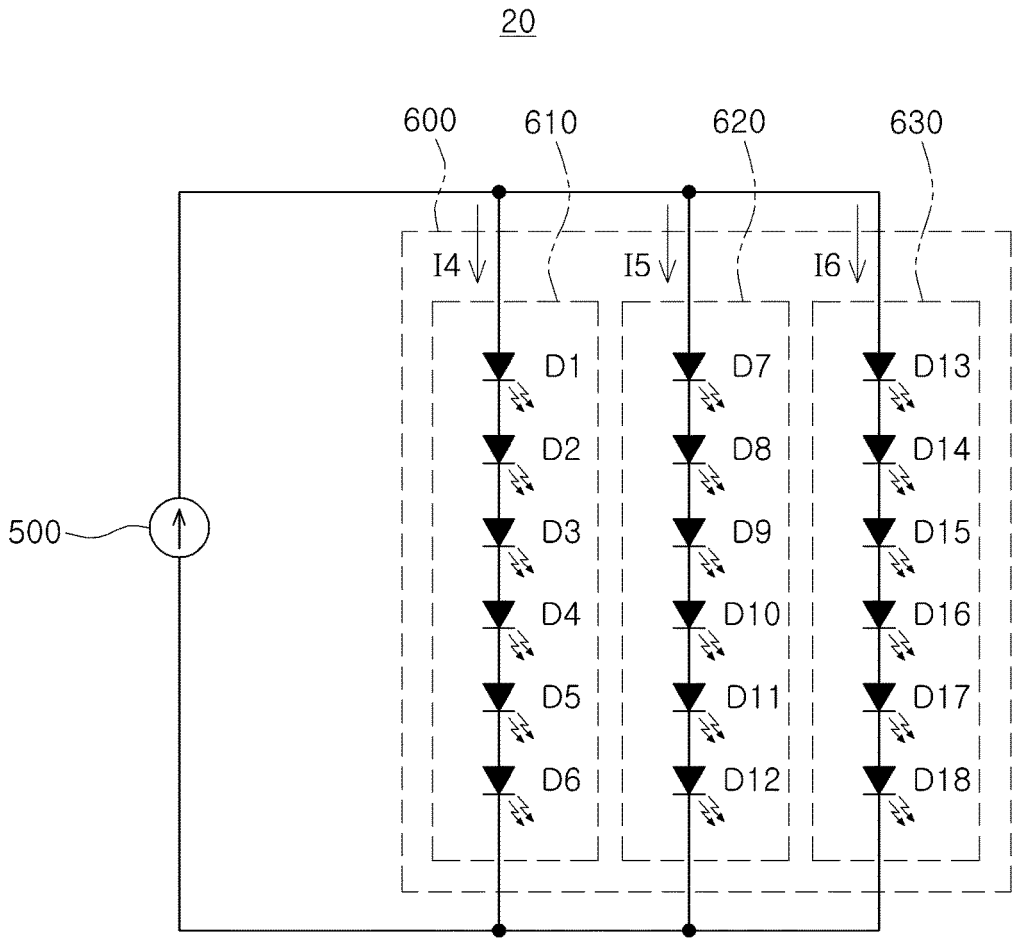
FIG. 7 is a comparative example embodiment of the light source device in FIG. 1.
Figure 8:
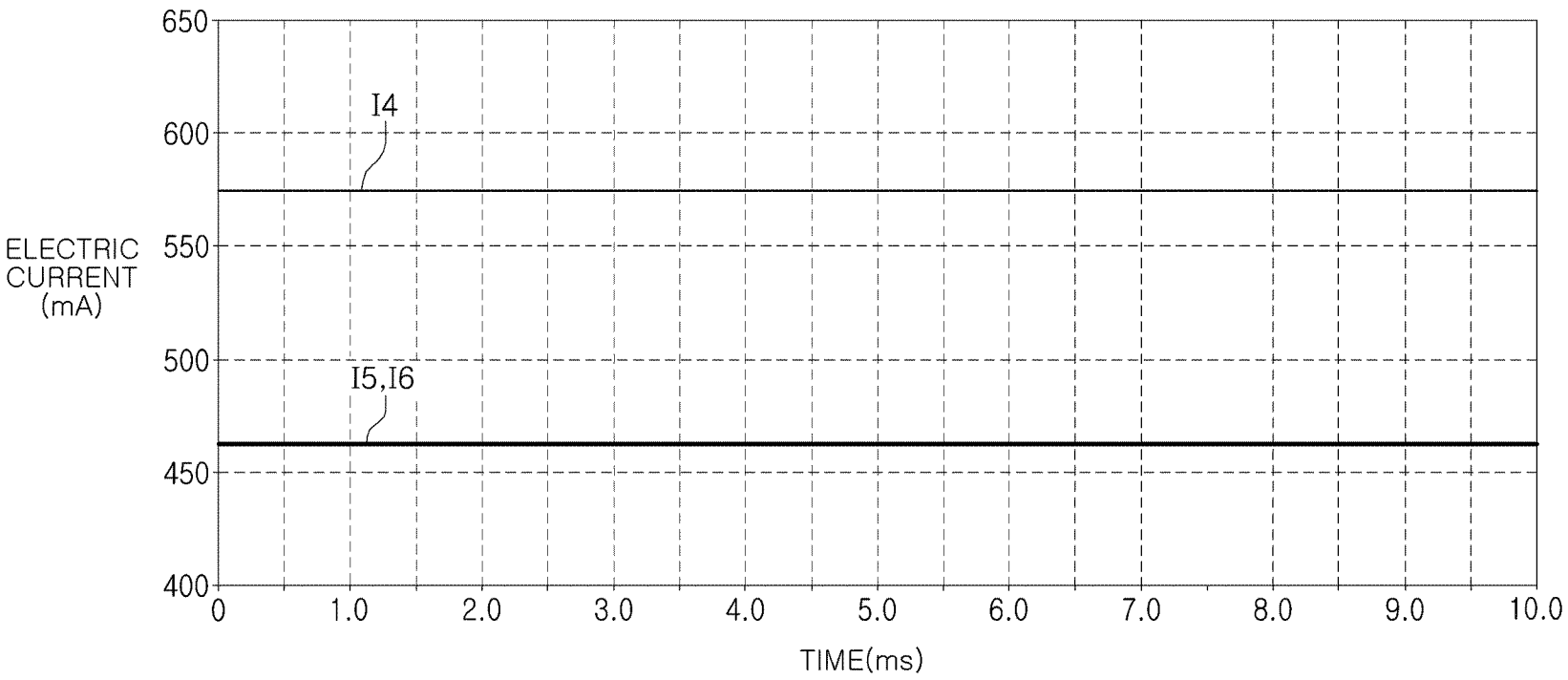
FIGS. 8 and 9 are respective graphs illustrating a current value applied to a first LED string, a second LED string, and a third LED string of the light source device according to the exemplary embodiments of FIGS. 7 and 1.
Figure 9:
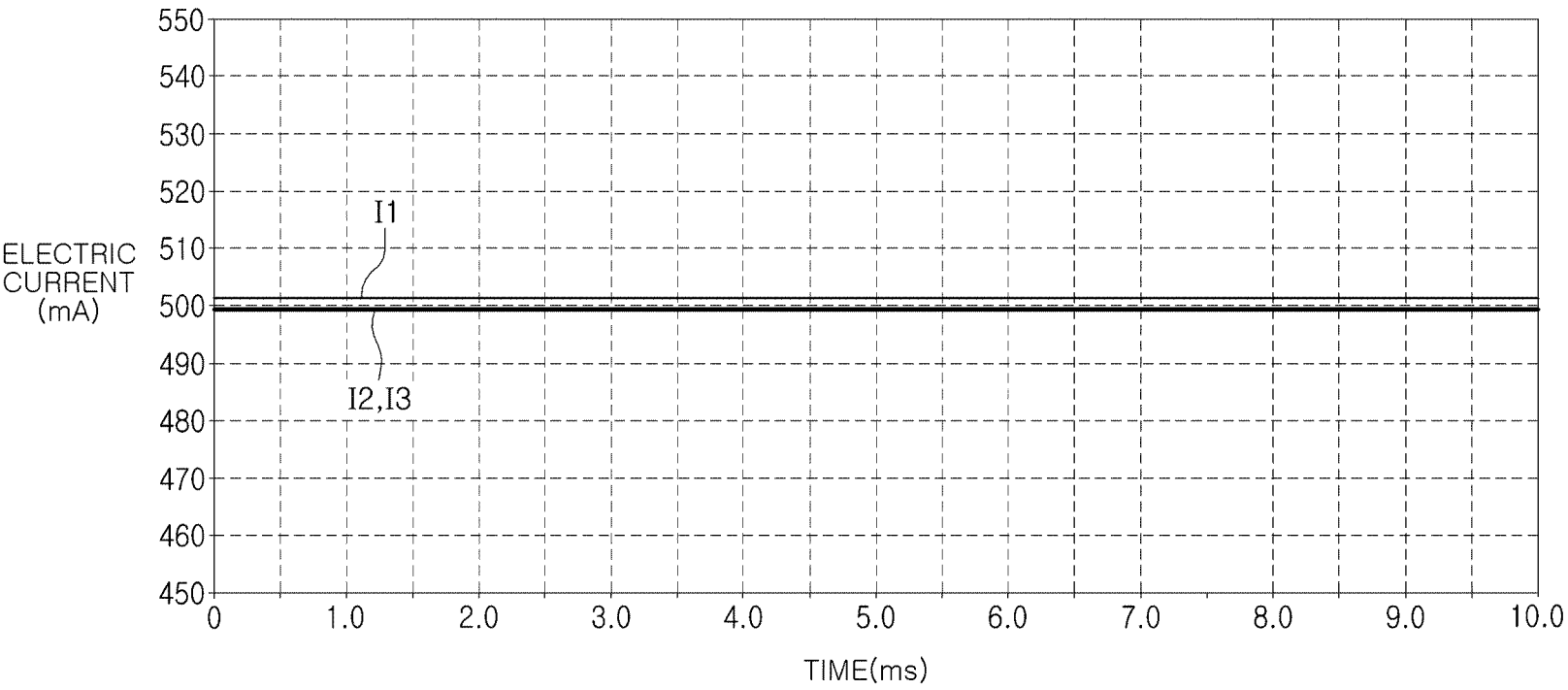

FIG. 7 is a comparative example of the light source device in FIG. 1, while FIGS. 8 and 9 are graphs illustrating a current value applied to respective LED strings of the light source device in FIGS. 7 and 1. A light source device 20 in FIG. 7 may comprise a light emitting device array 600 including a plurality of LED strings 610, 620, and 630 connected to each other in parallel, as well as a power supply unit 500. In addition, the plurality of LED strings 610, 620, and 630 may include a plurality of light emitting devices D1 to D6, D7 to D12, and D13 to D18, connected in series, respectively, but a voltage compensation unit may be omitted. Graphs of FIGS. 8 and 9 illustrate results produced under a condition in which a current input to a power supply unit 100 or the power supply unit 500 is 1.5 A, a level of a forward voltage of an LED string 210 is lower than that of respective different LED strings 220 and 230, and a level of a forward voltage of an LED string 610 is lower than that of respective different LED strings 620 and 630, by 0.1 to 0.15V.

In the case of the light source device 20 in FIG. 7, in which a voltage compensation unit is omitted, it has been determined that an electric current I4 of 575 mA is applied to the LED string 610 having a relatively low forward voltage, while an electric current I5 of 462 mA and an electric current I6 of 462 mA are applied to the different LED strings 620 and 630, respectively, as illustrated in FIG. 8, and thus a current deviation of 113 mA may occur. Therefore, it can be determined that an electric current having a level about 20% higher than that of an electric current of respective different LED strings 620 and 630 is applied to the LED string 610, which has a relatively low forward voltage.

In the case of a light source device 10 in FIG. 1, in which a voltage compensation unit is adopted, it has been determined that an electric current I1 of 501 mA is applied to the LED string 210 having a relatively low forward voltage, while an electric current I2 of 499 mA and an electric current I3 of 499 mA are applied to the different LED strings 220 and 230, respectively, as illustrated in FIG. 9, and thus a current deviation of 2 mA may occur. Therefore, compared to a case described above, in which the voltage compensation unit is omitted, a current deviation may be decreased by 111 mA, thus reducing a phenomenon of non-uniform distribution of an electric current.

As set forth above, according to example embodiments of the present disclosure, a light emitting device array in which a forward voltage deviation among a plurality of LED strings is reduced, thus reducing a phenomenon of non-uniform distribution of an electric current, and a light source device using the same may be provided.

While example embodiments have been shown and described above, it will be apparent to those skilled in the art that modifications and variations could be made without departing from the scope of the present inventive concept as defined by the appended claims.

What is claimed is:

1. A light emitting device array, comprising:

a plurality of light emitting diode (LED) strings connected in parallel with each other, each LED string including a plurality of light emitting devices connected in series, wherein a sum of forward voltages (Vf) of corresponding plurality of light emitting devices included in at least one LED string among the plurality of LED strings is less than a sum of forward voltages of corresponding plurality of light emitting devices included in a different LED string, and the at least one LED string includes a voltage compensation unit configured to compensate for a difference in forward voltage levels between the at least one LED string and the different LED string.

2. The light emitting device array of claim 1, wherein the voltage compensation unit comprises at least one of a resistor and a diode.

3. The light emitting device array of claim 1, wherein the voltage compensation unit is included in only a portion among the plurality of LED strings.

4. The light emitting device array of claim 1, wherein the voltage compensation unit comprises a wiring having different patterns in a region corresponding to the different LED string.

5. The light emitting device array of claim 4, wherein a pattern of a wiring of the voltage compensation unit is narrower than a pattern of a wiring of the different LED string.

6. The light emitting device array of claim 4, wherein a pattern path of the wiring of the voltage compensation unit is longer than a pattern path of the wiring of the different LED string.

7. The light emitting device array of claim 4, wherein the plurality of LED strings comprise a circuit board on which the plurality of light emitting devices are mounted, and the voltage compensation unit is provided as a circuit wiring printed on the circuit board.

8. The light emitting device array of claim 7, wherein the circuit board comprises an electrode pad measuring a forward voltage applied to opposing ends of the plurality of light emitting devices.

9. The light emitting device array of claim 1, wherein the voltage compensation unit is connected to the at least one LED string in series.

10. The light emitting device array of claim 1, wherein each of the plurality of LED strings comprises the same number of light emitting devices.

11. The light emitting device array of claim 1, wherein the voltage compensation unit is disposed on at least one end between opposing ends of the plurality of LED strings.

12. A light source device, comprising:

a plurality of LED strings connected in parallel, each LED string including a plurality of light emitting devices connected in series, wherein each of the plurality of LED strings includes an impedance controlling pattern electrically connected to a corresponding plurality of light emitting devices, and is configured such that a level of a forward voltage applied to the corresponding plurality of light emitting devices included in at least one LED string among the plurality of LED strings is lower than a level of a forward voltage applied to the corresponding plurality of light emitting devices included in a different LED string, and the at least one LED string includes an impedance controlling pattern, different from an impedance controlling pattern of the different LED string and connected to the corresponding plurality of light emitting devices in series, and the impedance controlling pattern included in the at least one LED string is configured to compensate for a difference in forward voltage levels applied to the at least one LED string and to the different LED string.

13. The light source device of claim 12, further comprising a power supply unit supplying driving power to the plurality of LED strings, wherein the power supply unit supplies substantially the same level of electric current to each of the plurality of LED strings.

14. The light source device of claim 12, wherein the impedance controlling pattern of the at least one LED string is narrower than the impedance controlling pattern of the different LED string, or has a path longer than a path of the different LED string.

15. The light source device of claim 12, wherein the impedance controlling pattern of the at least one LED string is laser trimmed.

16. A light emitting device array, comprising:

a first light emitting diode (LED) string connected in parallel with a second LED string, each of the first and second LED strings including a plurality of light emitting devices connected in series, a voltage compensation unit connected in series to one of opposing ends of the plurality of light emitting devices included in the first LED string, wherein a sum of forward voltages (Vf) of the plurality of light emitting devices included in first LED string is less than a sum of forward voltages of the plurality of light emitting devices included in the second LED string, and the voltage compensation unit is configured to compensate for a difference in forward voltage levels between the first LED string and the second LED string.

17. The light emitting device array of claim 16, wherein the voltage compensation unit comprises at least one of a resistor and a diode.

18. The light emitting device array of claim 16, wherein the voltage compensation unit included in the first LED string comprises a wiring having different patterns in a region corresponding to the second LED string.

19. The light emitting device array of claim 18, wherein a pattern of a wiring of the voltage compensation unit is narrower than a pattern of a wiring of the second LED string.

20. The light emitting device array of claim 18, wherein a pattern path of the wiring of the voltage compensation unit included in the first LED string is longer than a pattern path of the wiring of the second LED string.

* * * * *